United States Patent [19]

Besemann

[11] 4,364,552

[45] Dec. 21, 1982

[54] METHOD AND APPARATUS FOR FORMING A STREAM OF PARTIALLY OVERLAPPING PAPER SHEETS OR THE LIKE

[75] Inventor: Alfred Besemann, Hamburg, Fed. Rep. of Germany

[73] Assignee: E.C.H. Will (GmbH & Co.), Hamburg, Fed. Rep. of Germany

[21] Appl. No.: 188,677

[22] Filed: Sep. 19, 1980

[30] Foreign Application Priority Data

Sep. 28, 1979 [DE] Fed. Rep. of Germany ..... 2939277

[51] Int. Cl.[3] ..... B65H 29/68

[52] U.S. Cl. ..... 271/182; 83/88; 271/202

[58] Field of Search ..... 271/182, 202, 183, 203, 271/270, 229, 230, 314; 83/88

[56] References Cited

U.S. PATENT DOCUMENTS

| | | | |
|---|---|---|---|
| 3,228,273 | 1/1966 | Huffman | 83/88 X |
| 3,685,823 | 8/1972 | Chambon | 271/270 X |
| 3,944,212 | 3/1976 | Stange et al. | 271/65 X |
| 4,040,617 | 8/1977 | Walkington | 271/202 X |
| 4,285,513 | 8/1981 | Kwasnitza | 271/202 X |

FOREIGN PATENT DOCUMENTS

| | | | |
|---|---|---|---|
| 634158 | 8/1936 | Fed. Rep. of Germany . | |
| 1461212 | 12/1968 | Fed. Rep. of Germany . | |
| 1461244 | 12/1968 | Fed. Rep. of Germany | 271/182 |
| 1561728 | 7/1970 | Fed. Rep. of Germany . | |

*Primary Examiner*—Bruce H. Stoner, Jr.
*Attorney, Agent, or Firm*—Kontler, Grimes & Battersby

[57] ABSTRACT

A series of separate paper sheets issuing from a cross cutter wherein a running paper web is subdivided into discrete sheets is converted into a stream of partly overlapping sheets by transporting the sheets of the series at a first speed onto the upper reach of a belt conveyor which is driven at a lower second speed. A cylindrical braking roller is adjacent to the sheet-receiving end of the upper reach of the belt conveyor and is driven at a peripheral speed matching the second speed. A flat of the otherwise cylindrical peripheral surface of the braking roller is adjacent to but out of contact with the leading edges of successive sheets of the series but the cylindrical surface of the roller engages the intermediate portions of successive sheets and decelerates such sheets from the first to the second speed. This ensures that reaction liquid cannot escape at the leading edges of successive sheets which constitute carbon-free pressure-sensitive copy paper sheets. The belt conveyor is located at a level below the level of oncoming sheets which advance at the first speed and cooperates with a rotary cam having a lobe which pushes the trailing edges of successive decelerated sheets onto the upper reach of the belt conveyor so that the leading edges of the oncoming sheets overlie the depressed trailing edges of the preceding sheets.

7 Claims, 4 Drawing Figures

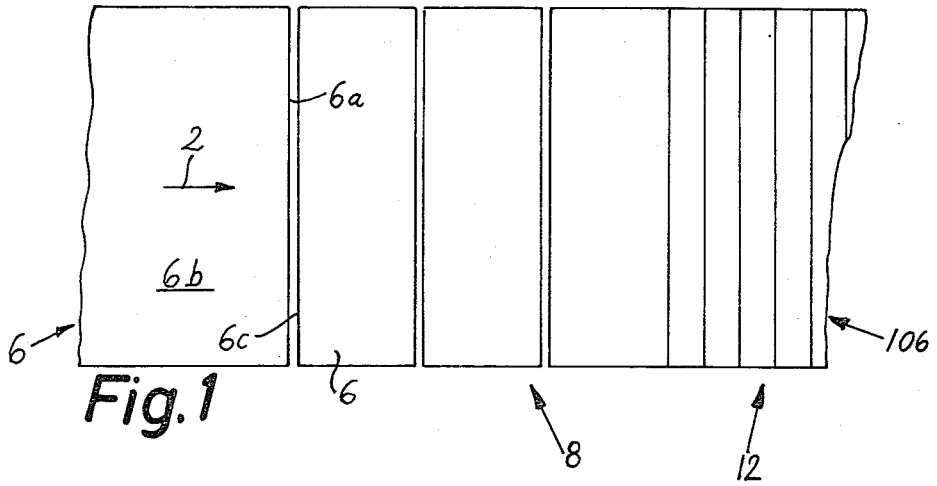
Fig.1
Fig.2
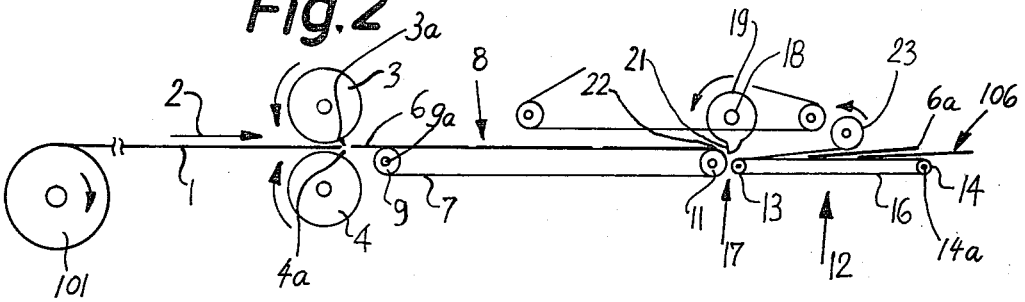
Fig.3
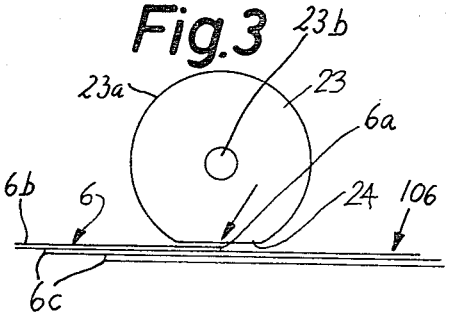
Fig.4
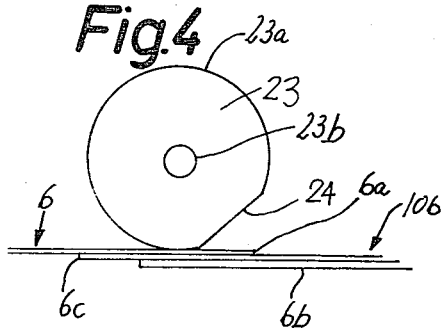

METHOD AND APPARATUS FOR FORMING A STREAM OF PARTIALLY OVERLAPPING PAPER SHEETS OR THE LIKE

BACKGROUND OF THE INVENTION

The present invention relates to a method and apparatus for processing paper sheets or the like, and more particularly to improvements in a method and apparatus for converting a series of non-overlapping sheets into a stream of partially overlapping sheets, i.e., into a scaly or imbricated stream. Still more particularly, the invention relates to a method and apparatus which can be resorted to for conversion of discrete sheets issuing from a cross cutter into a stream of partially overlapping sheets wherein the leading edge of each next-following sheet overlaps the trailing edge of the preceding sheet.

It is already known to convert a series of separate sheets into a stream of partially overlapping sheets by advancing the sheets of the series at a first speed and by decelerating successive sheets of the series so that each next-following sheet extends forwardly beyond and overlaps the trailing edge of the preceding sheet before it undergoes a braking action in order to accomplish deceleration from the first to the lower second speed. The means for applying an appropriate braking force is normally a rotary member which engages the leading edges of successive sheets of the series. Such apparatus are important and frequently essential components of many processing machines, for example, of cross cutters which serve to subdivide one or more running paper webs into discrete sheets prior to conversion of such sheets into stacks. The stacks are or can be converted into pads, tablets, not books or other stationery products. The cross cutter draws one or more webs from one or more reels or analogous sources and includes cooperating knives and counterknives which sever the web or webs transversely at regular intervals so that each web yields a series of discrete sheets. The sheets of each series are transported to a gathering station and thereupon to a stacking station.

The aforementioned second speed of heretofore known apparatus for conversion of a series of sheets into a stream of partially overlapping sheets is normally a small fraction (e.g., between 30 and 40 percent) of the first speed. Thus, an oncoming sheet of the series travels at a speed which appreciably exceeds the speed of the stream and, therefore, such oncoming sheet must be subjected to a very pronounced braking action. The peripheral speed of the braking member in such conventional apparatus matches the second speed. As a rule, the braking member is a roller which is adjacent to the path of the rearmost sheet of the stream. As mentioned above, the peripheral surface of the rotating roller engages the leading edge of the oncoming foremost sheet of the series and applies a pronounced braking force in order to prevent the oncoming sheet from fully overlapping the preceding sheet or from advancing forwardly and beyond the preceding sheet.

Problems arise when such conventional apparatus are used for the processing of pressure-sensitive material, for example, in connection with the processing of carbon-free copy paper which can be used to make copies solely as a result of the application of mechanical pressure against its surface. In many instances, such carbon-free copy paper is furnished in the form of a continuous web consisting of several superimposed layers. The web is fed into a cross cutter wherein the knives cooperate to sever the web at regular intervals so that the web yields a series of sheets each of which consists of several layers. For example, it is customary to form webs which contain between two and six superimposed layers. When a multi-layer sheet of the series downstream of the cross cutter reaches the aforementioned braking roller of a conventional apparatus for the formation of a stream of partially overlapping sheets, the peripheral surface of the roller engages and applies a pronounced pressure (braking force) against the multi-layer sheet in the region of the leading edge of the sheet and urges the latter against the adjacent sheet or sheets of the stream. This causes at least some reaction fluid to issue from the sheet at the leading edge and to penetrate into the wedge-like gap between the peripheral surface of the braking roller and the stream. The reaction liquid is a conventional constituent of aforediscussed carbon-free copy sheets. The liquid which issues at the leading edge of a multi-layer sheet is not only likely to contaminate the adjacent sheet or sheets of the stream but is even more likely to leave unsightly and highly undesirable depressions or markings in the surface or surfaces of the adjacent sheets because it is urged against such surface or surfaces with a pronounced force, namely, with a force which the braking roller applies to decelerate successive oncoming multi-layer sheets of the series. The markings are more or less pronounced, depending on the composition of the multi-layer sheets and also on the magnitude of the braking force which is applied by the roller.

OBJECTS AND SUMMARY OF THE INVENTION

An object of the invention is to provide a novel and improved method of converting a series of discrete sheets into a stream of partially overlapping sheets in such a way that the leading edges or the regions of leading edges of successive sheets of the series need not be subjected to any or are subjected to negligible mechanical stresses.

Another object of the invention is to provide a method which can be practiced with particular advantage in connection with the processing of multi-layer sheets of carbon-free copy paper or the like.

A further object of the invention is to provide a method which can be resorted to for conversion of pressure-sensitive multi-layer sheets of copy paper into a stream of partially overlapping sheets without permitting any reaction fluid to penetrate beyond the edges of such sheets.

An additional object of the invention is to provide a method which can be resorted to for conversion of a series of sheets issuing from a modern high-speed cross cutter into one or more streams of partially overlapping sheets.

A further object of the invention is to provide a novel and improved apparatus for the practice of the above outlined method.

Another object of the invention is to provide the apparatus with braking means which acts upon the sheets of the series in such a way that the edges of the sheets are not subjected to any or are subjected to negligible mechanical stresses, i.e., that the edges cannot be subjected to mechanical stresses of a magnitude which is required to provoke the expulsion of some reaction liquid beyond the edges of a multi-layer sheet of carbon-free pressure-sensitive copy paper.

A further object of the invention is to provide a novel and improved system for transporting sheets in an apparatus of the just outlined character.

One feature of the invention resides in the provision of a method of converting a series of non-overlapping sheets into a stream of partially overlapping sheets, particularly for converting a series of non-overlapping (normally spaced-apart equidistant) paper sheets which issue from a cross cutter wherein a continuous running paper web is severed to yield discrete sheets. The method comprises the steps of advancing the sheets of the series at a first speed in a predetermined direction along a first portion of a predetermined (e.g., horizontal or nearly horizontal) path wherein each sheet has a leading edge, an intermediate portion behind the respective leading edge (as considered in the aforementioned direction) and a trailing edge behind the respective intermediate portion, and applying a braking force to the intermediate portions of successive sheets of the series in a second portion of the path downstream of the first portion so as to reduce the speed of such sheets from the first speed to a lower second speed whereby each sheet which enters the second portion of the path and is about to be braked partially overlaps with the preceding sheet.

The second portion of the path can be located at a level below the first portion so that the leading edge of a sheet entering the second portion of the path overlies the trailing edge of the preceding sheet. The method then preferably further comprises the step of forcibly moving (e.g., by the lobe of a rotary cam) the trailing edges of successive sheets of the series to the level of the second portion of the path immediately after such trailing edges advance beyond the first portion of the path.

If the path is horizontal or nearly horizontal, the step of applying braking force preferably includes frictionally engaging the upper sides of the intermediate portions of successive sheets of the series.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a plan view of a series of paper sheets prior and subsequent to conversion into a stream of partially overlapping sheets;

FIG. 2 is a schematic side elevational view of an apparatus which embodies the invention;

FIG. 3 is a greatly enlarged end elevational view of the rotary braking device in the apparatus of FIG. 2; and FIG. 4 shows the braking device of FIG. 3 in a different angular position.

DESCRIPTION OF THE PREFERRED EMBODIMENTS

The apparatus which embodies the present invention is shown in FIG. 2. It comprises a transporting unit having a first conveyor section 8 and a second conveyor section 12. The conveyor section 8 comprises an endless belt conveyor 7 (which may be a composite conveyor consisting of several narrow belts disposed in parallel vertical planes) trained over pulleys 9, 11 and having a horizontal or substantially horizontal upper reach which advances in the direction indicated by arrow 2. The upper reach of the conveyor 7 receives a series of equally spaced discrete sheets 6 from a cross cutter having two rotary knife carries or holders 3, 4 for knives 3*a*, 4*a* which cooperate to sever a continuous running web 1 of paper or the like at regular intervals. The web 1 is drawn from a source 101 (e.g., a reel or bobbin storing a supply of copy paper which is carbon-free and produces indicia in response to the application of mechanical pressure thereto). The web 1 may consist of several (e.g., between two and six) superimposed layers. The arrow 2 indicates the direction in which the web 1 is transported into the range of the knives 3*a*, 4*a* on the holders 3 and 4. These holders can be constructed, assembled, driven and controlled in a manner as disclosed in the copending application Ser. No. 953,964 filed Oct. 23, 1978 by Willy Rudszinat, now U.S. Pat. No. 4,255,998, or in U.S. Pat. No. 4,201,102 granted May 6, 1980 to Rudszinat.

The pulley 9 or 11 may constitute a means for driving the conveyor 7 at a predetermined (first) speed which is relatively high and preferably matches or somewhat exceeds the peripheral speed of the holders 3 and 4. The shaft 9*a* of the pulley 9 is assumed to be driven by the prime mover (not shown) of the cross cutter.

The second conveyor section 12 of the transporting unit comprises an endless belt conveyor 16 (or a series of discrete belts located in parallel vertical planes) which is trained over pulleys 13 and 14. The shaft 14*a* of the pulley 14 is driven at a speed which is sufficiently low to ensure that the belt conveyor 16 travels at a fraction of the speed of the belt conveyor 7, for example, at a second speed which is between 40 and 60 (preferably about 50) percent of the speed of the belt conveyor 7. The upper reach or stretch of the conveyor 16 is horizontal or nearly horizontal and is located at a level below the upper reach of the conveyor 7. The conveyor 16 transports a continuous scaly or imbricated stream 106 of partially overlapping sheets 6 in a direction to the right, as viewed in FIG. 2.

Since the upper reaches of the conveyors 7 and 16 are disposed at different levels, a step or shoulder 17 develops between the pulleys 11 and 13. A device for mechanically (forcibly) moving the trailing edges 6*c* (or the sheet portions which are adjacent to the trailing edges) of successive sheets 6 arriving with the upper reach of the conveyor 7 is disposed in the region of the step 17. This device comprises a rotary cam 19 which has a projection or lobe 21 and is driven by a horizontal shaft 18 in synchronism with the pulley 11 and holders 3, 4 so that the lobe 21 depresses the trailing edge 6*c* of each successive sheet 6 of the series of sheets on the conveyor 7 from the level of the upper reach of the conveyor 7 to the level of the upper reach of the conveyor 16. This ensures that the leading edge 6*a* of the next-following (oncoming) sheet 6 overlies the trailing edge 6*c* of the preceding sheet 6, i.e., this contributes to conversion of the series of sheets 6 on the conveyor 7 into the scaly stream 106 of partially overlapping sheets 6 on the conveyor 16. The angular movement of the cam 19 is synchronized with the forward movement of the sheets 6 on the conveyor 7 in such a way that the cam 21 moves to a level below the apex of the pulley 11 and depresses the trailing edge 6*c* toward the upper reach of the conveyor 16 as soon as the respective sheet 6 advances, in its entirety, beyond the step or shoulder 17. The shaft 18 can derive motion from the shaft for the holder 3 or 4.

It will be noted that the cam 19 does not engage the leading edge 6*a* and/or the intermediate portion 6*b* (between the edges 6*a* and 6*c*) of a sheet 6 which is delivered by the conveyor 7. Thus, the leading edge 6*a* of each of the series of sheets 6 which are delivered by the conveyor 7 can advance, without any interference, beyond the shoulder or step 17 and beyond a braking force applying or braking device 23 the details of which are shown in FIGS. 3 and 4. The braking device 23 is an elongated roller which extends transversely of the path of movement of sheets 6 which form the scaly stream 106 and has a peripheral surface including a cylindrical portion 23*a* as well as a flat 24. The roller 23 is driven by a shaft 23*b* which derives motion from the pulley 14 or from the drive shaft 14*a* for the pulley 14 and causes the roller 23 to rotate at a peripheral speed which matches or very closely approximates the speed of the upper reach of the conveyor 16. In accordance with a feature of the invention, the angular movement of the roller 23 is synchronized with the forward movement of sheets 6 on the upper reach of the conveyor 7 in such a way that the flat 24 is adjacent to but is out of braking-force-applying engagement with the leading edges 6*a* of successive sheets 6. However, the cylindrical portion 23*a* of the peripheral surface of the roller 23 invariably engages the intermediate portion 6*b* of the adjacent sheet 6 (i.e., that portion which is adjacent to and is located behind the respective leading edge 6*a*) to decelerate the sheet 6 from the (first) speed of the conveyor 7 to the (second) speed of the conveyor 16. This results in conversion of the series of sheets 6 which are delivered by the conveyor 7 into the scaly or imbricated sheet stream 106 on the upper reach of the conveyor 16. Since the roller 23 does not engage (and hence decelerate) the leading edges 6*a* of successive sheets 6, each such sheet can advance to a position of partial overlap with the preceding sheet, i.e., with the last sheet of the stream 106. As mentioned above, the lobe 21 of the rotating cam 19 ensures that the leading edges 6*a* of next-following sheets 6 overlie the trailing edges 6*c* of the preceding sheets 6 on the upper reach of the conveyor 16, i.e., the cam 19 contributes to reliable conversion of the series of spaced-apart (and preferably equidistant) sheets 6 which are delivered by the conveyor 7 into a uniform stream 106 wherein the extent to which a preceding sheet is overlapped by the next-following sheet is always or nearly always the same. As mentioned above, the speed of the conveyor 16 is preferably about 50 percent of the speed of the conveyor 7, i.e., the peripheral speed of the braking roller 23 is approximately or exactly half the speed of forward movement of the upper reach of the conveyor 7. The cylindrical portion 23*a* of the peripheral surface of the braking roller 23 bears against the intermediate portions 6*b* of successive sheets 6 with a force which suffices to guarantee that the sheets 6 are braked, i.e., that the speed of such sheets is reduced from the (first) speed of the conveyor 7 to the (second) speed of the conveyor 16. However, the distance between the locus of engagement between the cylindrical portion 23*a* of the peripheral surface of the braking roller 23 with the intermediate portions 6*b* (namely with the upper sides of such intermediate portions because the path portion defined by the upper reach of the conveyor 16 is horizontal and the roller 23 is mounted above such upper reach) and the leading edges 6*a* of the sheets 6 suffices to ensure that reaction liquid cannot escape by way of the leading edges, i.e., the liquid which is contained in pressure-sensitive sheets cannot contaminate the apparatus and/or the sheets 6 of the stream 106 and cannot exert pressure against the sheets of the stream 106 in the region where the roller 23 coacts with the stream to reduce the forward speed of successive oncoming sheets 6. The braking action is furnished by the peripheral surface portion 23*a* of the braking roller 23 as well as by the adjacent sheet of the stream 106, namely, by a sheet of the stream whose speed already matches or very closely approximates the speed of the conveyor 16.

The manner in which the stream 106 is further processed forms no part of the present invention. For example, the stream 106 can be transferred onto one or more additional conveyors which are driven at the speed of the conveyor 16 (or at a lower speed) and serve to deliver the sheets of the stream 106 to a gathering station wherein successive portions of the stream 106 are converted into stacks of partially or fully overlapped sheets. Such stacks can be moved through an aligning station and therefrom to a production line which assembles the stacks with covers and connects them to the respective covers by spiral binders, by glue, by threads and/or in any other suitable way to form a succession of steno books, exercise books, legal size pads or like stationery products.

It is also within the purview of the invention to replace the braking roller 23 with an eccentrically mounted roller which is driven in synchronism with movement of the sheets 6 toward and through the braking station above the conveyor 16 so that the eccentrically mounted roller is lifted above the leading edge 6*a* of an oncoming sheet 6 but descends and frictionally engages and thereby brakes the intermediate portion 6*b* of such sheet. Still further, it is possible to employ a cylindrical roller without any flats and to resort to one or more eccentrics which raise and lower the cylindrical roller at necessary intervals so that the roller skips (does not come into contact with) the leading edges 6*a* of successive sheets but invariably engages and brakes the intermediate portion 6*b* of each sheet therebelow. The braking roller which is shown in FIG. 3 (in an angular position in which it allows the leading edge 6*a* of a sheet 6 to pass) and FIG. 4 (in a position in which the cylindrical portion 23*a* of its peripheral surface engages the intermediate portion 6*b* of a sheet 6) is preferred at this time because it is very simple and its angular movements can be readily synchronized with those of other moving parts in the apparatus as well as in the cross cutter.

An important advantage of the improved apparatus is that it can treat the sheets 6 gently, i.e., the sheets can be braked for relatively long periods of time because the cylindrical portion 23*a* of the peripheral surface of the roller 23 can remain in long-lasting braking engagement with the intermediate portions 6*b* of successive sheets 6. Furthermore, the improved apparatus can be used with particular advantage for the processing of afore-discussed carbon-free copy paper sheets which are likely to bleed reaction liquid if engaged at their leading edges.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting a series of non-overlapping sheets into a stream of partially overlapping sheets, particularly for converting a series of non-overlapping paper sheets which issue from a cross cutter wherein a running paper web is severed to yield discrete sheets, comprising transporting means for advancing the sheets in a predetermined direction along a predetermined path, said transporting means including first conveyor means for advancing the sheets of said series at a first speed along a first portion of said path wherein each sheet has a leading edge, an intermediate portion behind the respective leading edge and a trailing edge behind the respective intermediate portion, said transporting means further including second conveyor means for advancing the sheets of said stream at a lower second speed along a second portion of said path downstream of said first portion, as considered in said direction; and a braking roller having a generally cylindrical peripheral surface of substantially constant radius over an arc in excess of 180° and also including at least one flat portion on said surface which is adjacent to but out of braking engagement with the leading edge of each sheet entering said second portion of said path, wherein the entire cylindrical peripheral surface of said braking roller is adapted to engage and brake the intermediate portions of successive sheets of said series on entry into said second portion of said path to thereby decelerate such sheets from said first speed substantially to said second speed whereby each sheet which advances beyond said first portion of said path overlaps with the freshly decelerated sheet.

2. The apparatus of claim 1, further comprising means for driving said roller so that the peripheral speed of said roller at least approximates said second speed.

3. The apparatus of claim 2, wherein said second conveyor means includes an endless conveyor having an elongated reach which defines said second portion of said path, said reach having a sheet-receiving end adjacent to said first conveyor means and to said roller.

4. The apparatus of claim 1, wherein said second portion of said path is located at a level below said first portion and further comprising means for forcibly moving the trailing edges of successive sheets to the level of said second portion of said path immediately after such trailing edges leave said first portion of said path so that the leading edge of each sheet which advances beyond said first portion is located above and overlies the trailing edge of the preceding sheet.

5. The apparatus of claim 4, wherein said moving means comprises a rotary cam having a sheet-engaging projection.

6. The apparatus of claim 1, wherein said path is substantially horizontal and the sheets of said series are spaced apart and substantially equidistant from each other in said first portion of said path.

7. Apparatus for converting a series of non-overlapping sheets into a stream of partially overlapping sheets, comprising transporting means for advancing the sheets in a predetermined direction along a predetermined path, said transporting means including first conveyor means for advancing the sheets of said series at a first speed along a first portion of said path wherein each sheet has a leading edge, an intermediate portion behind the respective leading edge and a trailing edge behind the respective intermediate portion, said transporting means further including second conveyor means at a lower level than said first conveyor means for advancing the sheets of said stream at a lower second speed along a second portion of said path downstream of said first portion, as considered in said direction; wherein a rotary cam having a sheet engaging projection is provided between said first and second conveyor means for forcibly moving the trailing edges of successive sheets to the level of said second portion of said path immediately after such trailing edges leave said first portion of said path so that the leading edge of each sheet which advances beyond said first portion is located above and overlies the trailing edge of the preceding sheet; and wherein a braking roller is provided adjacent said second conveyor means, said braking roller having a generally cylindrical peripheral surface of substantially constant radius over an arc in excess of 180° and also including at least one flat portion on said surface which is adjacent to but out of braking engagement with the leading edge of each sheet entering said second portion of said path, the entire cylindrical peripheral surface of said braking roller being adapted to engage and brake the intermediate portions of successive sheets of said series on entry onto said second portion of said path to thereby decelerate such sheets from said first speed substantially to said second speed.

* * * * *